US009834960B2

(12) United States Patent
Chesterton et al.

(10) Patent No.: US 9,834,960 B2
(45) Date of Patent: Dec. 5, 2017

(54) WHEELED BOARD AND ACCESSORIES RACK

(71) Applicant: TANAWAA LLC, Parker, CO (US)

(72) Inventors: Nicholas Chesterton, Chico, CA (US); James Chesterton, Chico, CA (US)

(73) Assignee: TANAWAA LLC, Parker, CO (US)

( * ) Notice: Subject to any disclaimer, the term of this patent is extended or adjusted under 35 U.S.C. 154(b) by 0 days.

(21) Appl. No.: 14/820,841

(22) Filed: Aug. 7, 2015

(65) Prior Publication Data

US 2017/0037660 A1 Feb. 9, 2017

(51) Int. Cl.

| | |
|---|---|
| ***E05B 73/00*** | (2006.01) |
| ***A47F 7/00*** | (2006.01) |
| ***A63C 17/00*** | (2006.01) |
| *E05B 73/02* | (2006.01) |

(52) U.S. Cl.

CPC ..... *E05B 73/0094* (2013.01); *A63C 17/0006* (2013.01); *E05B 73/02* (2013.01)

(58) Field of Classification Search

CPC .... E05B 73/0094; E05B 73/00; E05B 69/006; A63C 17/0006; A63C 11/007; A63C 11/028; A63C 17/00; A63C 17/0013; A47B 81/00; A47B 81/005; A47B 81/02; B60R 9/12; A47F 7/0021; A47F 7/0028; A47F 7/024; A63B 55/40; B25H 3/04; B62H 3/12; B62H 3/02

USPC ..... 211/4, 85.7, 70.2, 70.5, 70.6, 66, 67, 68, 211/62, 63, 8, 9, 87.01, 75, 18; D6/552

See application file for complete search history.

(56) References Cited

U.S. PATENT DOCUMENTS

| | | | | | |
|---|---|---|---|---|---|
| 658,042 | A | * | 9/1900 | Mendel | A47G 25/12 211/63 |
| 2,028,694 | A | * | 1/1936 | Spinks | A47K 1/09 211/65 |
| 2,089,537 | A | * | 8/1937 | Champlin | A47G 21/14 211/70.6 |
| 2,472,058 | A | * | 6/1949 | Artley | A47K 1/09 211/119.009 |
| 2,805,777 | A | * | 9/1957 | Larson | B25H 3/04 211/106.01 |
| 2,833,419 | A | * | 5/1958 | Trumpy | B25B 13/56 206/376 |

(Continued)

FOREIGN PATENT DOCUMENTS

WO 2005095065 A1 10/2005

*Primary Examiner* — Jennifer E. Novosad
(74) *Attorney, Agent, or Firm* — Porzio Bromberg & Newman P.C.

(57) ABSTRACT

A rack to hold skateboards, longboards, scooters, motorcycle helmets, purses, umbrellas and other implements or accessories. The rack is adapted to be mounted on a wall or surface. The rack is formed of a lip extending from a rear support. The lip is formed of a series of rounded protrusions. Items to be held by the rack can be received over the protrusions. In one embodiment, each protrusion is angled at a predetermined angle from the front. This helps keep a received skateboard, scooter or other accessory at an appropriate angle such that the wheels or surface of the accessory will remain off an affixed wall to avoid damage to wall. The rack can also include a locking mechanism for locking adjacent protrusions. The rack is designed for safety by having rounded edges on all areas that protrude from the wall.

11 Claims, 19 Drawing Sheets

(56) References Cited

U.S. PATENT DOCUMENTS 3,095,092 A * 6/1963 Magarian ..... B25H 3/04 211/70.6
3,187,902 A * 6/1965 Nelson ..... B25H 3/04 211/70.6
3,698,563 A * 10/1972 Gordon ..... A47F 5/08 211/60.1
4,271,997 A * 6/1981 Michael ..... B60R 5/006 211/70.5
D266,457 S * 10/1982 Johnson ..... D12/422
4,583,647 A * 4/1986 Schinzing ..... A47B 81/007 211/60.1
D286,119 S * 10/1986 Enquist ..... D6/552
D294,442 S * 3/1988 Bordian ..... D6/528
4,830,198 A * 5/1989 Colquitt ..... B44D 3/123 211/13.1
D312,936 S * 12/1990 Lim ..... D6/552
4,984,693 A * 1/1991 Belokin, Jr. ..... A47F 5/0876 211/88.01
D327,197 S * 6/1992 Belokin, Jr. ..... D6/567
D342,637 S * 12/1993 Smith ..... D6/552
5,301,818 A * 4/1994 Dix ..... A47F 5/0876 211/106.01
5,305,897 A 4/1994 Smith
5,316,155 A * 5/1994 Collins ..... A47B 81/005 211/106.01
D353,294 S 12/1994 Belokin
D354,872 S * 1/1995 Dix ..... D6/552
5,626,244 A * 5/1997 Mesna ..... A47F 5/083 211/60.1
5,893,539 A * 4/1999 Tran ..... H02G 3/0443 248/282.1
6,120,224 A * 9/2000 Powell ..... B60P 7/15 410/143
6,293,412 B1 * 9/2001 Draper ..... E05B 73/00 211/4
D458,070 S * 6/2002 Bennett ..... D6/567
D458,789 S 6/2002 Loika
D468,591 S * 1/2003 Lillelund ..... D7/590
D472,091 S * 3/2003 Bell ..... D6/552
6,640,978 B2 11/2003 Reiser et al.
6,749,074 B1 * 6/2004 Hileman ..... A47B 81/005 211/60.1
D496,817 S * 10/2004 Martin ..... D6/553
D499,594 S 12/2004 Laitila
7,014,052 B2 * 3/2006 Dettorre ..... A47F 5/0838 211/18
7,175,031 B2 * 2/2007 Matthews ..... B25H 3/04 211/70.6
D582,338 S 12/2008 Nemec et al.
7,562,780 B2 * 7/2009 Gilpatrick ..... B08B 3/026 211/70.6
7,789,247 B2 9/2010 Loch
D666,083 S 8/2012 Mackay
8,251,342 B1 * 8/2012 Weiner ..... A63C 17/0006 211/106.01
8,371,457 B2 * 2/2013 Entz ..... A47B 43/00 211/104
D679,123 S 4/2013 Evangelista
8,453,853 B1 6/2013 Adams
8,596,588 B1 * 12/2013 Sikkema ..... H02G 3/30 211/70.6
D699,973 S * 2/2014 Pan ..... D6/553
8,807,501 B2 * 8/2014 Chung ..... F16M 13/02 211/70.8
D751,372 S 3/2016 Thompson
2002/0060194 A1 * 5/2002 Reiser ..... A63C 11/028 211/4
2003/0010735 A1 * 1/2003 Wuerth ..... A63C 11/007 211/85.7
2005/0056486 A1 * 3/2005 Butler ..... E06C 7/14 182/129
2006/0226321 A1 * 10/2006 Tracy ..... A63B 71/0045 248/301
2007/0210021 A1 * 9/2007 Whitehead ..... B25H 3/04 211/70.6
2007/0235400 A1 10/2007 Wald
2012/0006766 A1 * 1/2012 Mackay, Jr. ..... E05B 73/0094 211/4

* cited by examiner

WHEELED BOARD AND ACCESSORIES RACK

BACKGROUND OF THE INVENTION

Field of the Invention

The present invention relates generally to racks for sporting goods equipment and in particular to an improved rack for retaining a plurality of wheeled boards and/or accessories which prevents damage to affixed walls.

Description of Related Art

Skateboard racks for holding skateboards have been described. U.S. Pat. No. 6,293,412 describes a skateboard rack including a pair of struts spaced from one another by a cross bar. At the bottom of each of the struts is an elbow that terminates upwardly. Wheels of the skateboard can rest on the elbows to hang the skateboard on the rack. Aligned apertures in the cross bar and the elbow can receive a lock. In a skateboard assembly, a plurality of the individual skateboard racks are individually connected to horizontal bars. The horizontal bars are connected to vertical posts. This skateboard rack has the shortcoming that during use, the lower wheels contact the wall to which the skateboard rack is attached.

U.S. Pat. No. 7,014,052 describes a wall hanger for a skateboard having a mountable panel with two spaced apart upwardly arched hooks mounted on a panel. The upwardly arched hooks receive skateboard wheels or a scooter handle bar. An outwardly arched spacer arm below the hooks contacts the board or scooter to maintain the board or scooter away from the wall. This skateboard rack has the shortcoming that the arched spacer arm increases manufacturing costs, the arched spacer arm takes up additional space and can harm an individual that may bump or fall against the rack. It is desirable to provide an improved wheeled board and accessories rack of a one-piece construction having low manufacturing costs and providing safety.

SUMMARY OF THE INVENTION

The present invention relates to a rack to hold skateboards, longboards, scooters, motorcycle helmets, purses, umbrellas and other implements or accessories. The rack is adapted to be mounted on a wall or surface. The rack is formed of a lip extending from a rear support. The lip is formed of a series of rounded protrusions. Items to be held by the rack can be received over the protrusions. In one embodiment, adjacent protrusions hold wheels of a skateboard and a truck of the skateboard is positioned in a notch extending between the adjacent protrusions. The rack can be designed to fit any style of skateboard, scooter or accessory. The rack design allows multiple skateboards and/or other items to be mounted consecutively.

In one embodiment, each protrusion is angled at a predetermined angle from the front. This helps keep a received skateboard, longboard, scooter or other accessory at an appropriate angle such that the wheels or surface of the accessory will remain off an affixed wall to avoid damage to wall. The rack is designed for safety by having rounded edges on all areas that protrude from the wall. The rack can be flush mounted to the wall with a minimal amount of protrusion. Accordingly, the rack is safe for use in the home or public places and complies with health and safety regulations, for example the health and safety regulations mandated by the State of California.

In an alternate embodiment, the rack includes a locking mechanism for locking adjacent protrusions. Rotatable locking arms are attached to adjacent protrusions. The locking arms can be rotated over a received item. The locking arms include one or more locking apertures. The apertures of the adjacent locking arms can be aligned and a locking device can be received in the aligned locking apertures. In one embodiment, each locking arm includes three locking apertures at a 60 degree angle to one another to provide varied locking combinations. The locking arms can be used by pedestrians to lock up skateboards or scooters in public places as well as accessories, such as backpacks, purses, umbrellas or other items brought into the public place for example a classroom or building. The locking rack provides theft protection and provides protection for items from accidentally being knocked out of the rack or falling out of the rack in the event of an earthquake.

The invention will be more fully described by reference to the following drawings.

DETAILED DESCRIPTION

Figure 1A:
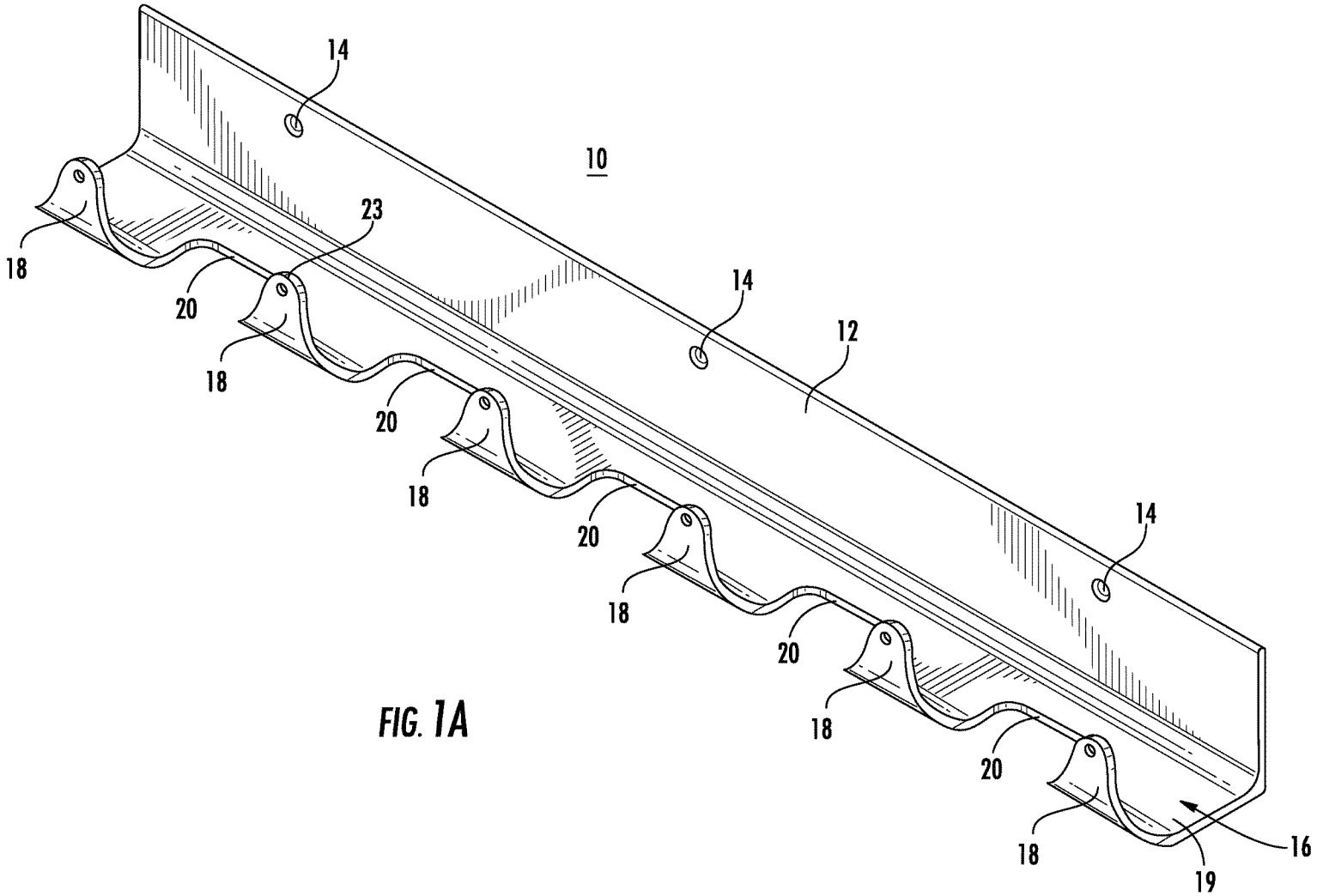
FIG. 1A is a perspective view of a wheeled board and accessories rack in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIGS. 1A-1E illustrate an embodiment of wheeled board and accessories rack 10 in accordance with the teachings of the present invention. Rear support 12 includes a plurality of apertures 14 as shown in FIG. 1A. Apertures 14 can receive attachment devices not shown for attaching rack 10 to a surface or wall.

Lip 16 extends substantially horizontally from rear support 12. Lip 16 includes a plurality of protrusions 18 extending from base support 19. Base support 19 can be substantially perpendicular to rear support 12. Notches 20 are positioned between adjacent protrusions 18.

Figure 1B:
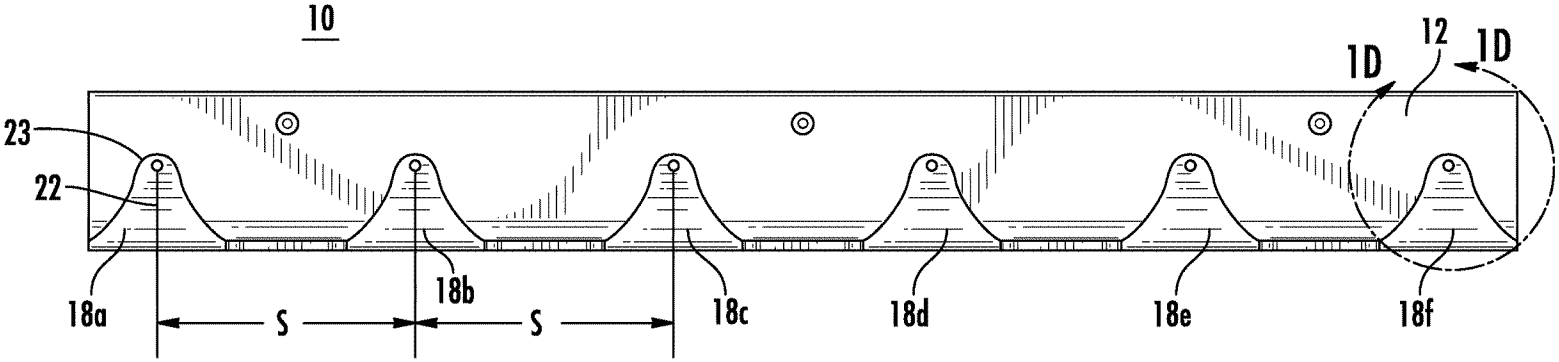
FIG. 1B is a front view of the wheeled board and accessories rack.
Figure 1C:
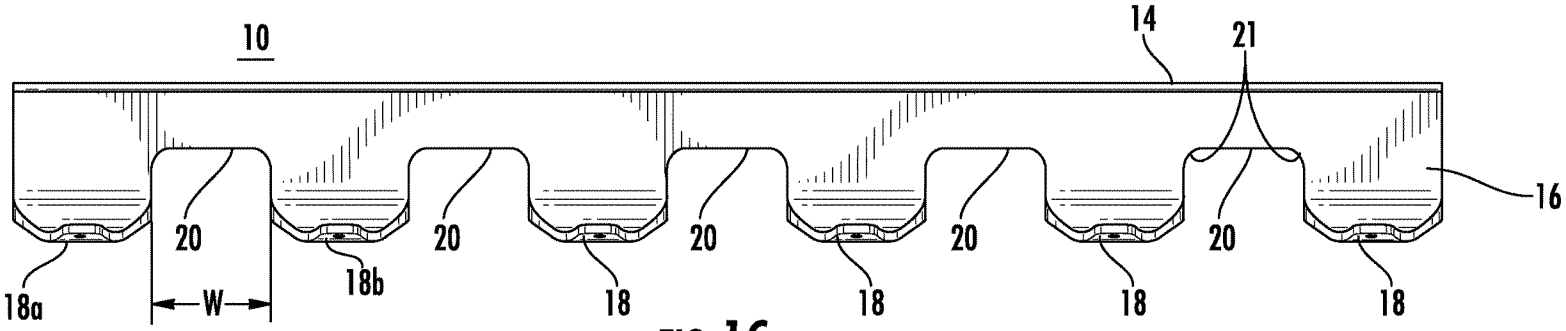
FIG. 1C is a top plan view of the wheeled board and accessories rack.
Figure 1D:
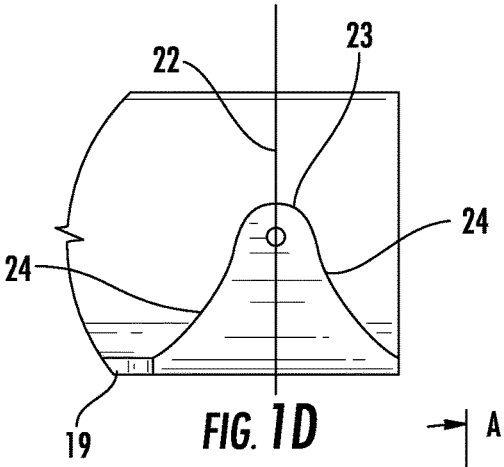
FIG. 1D is a detail view of FIG. 1B.
Figure 1E:
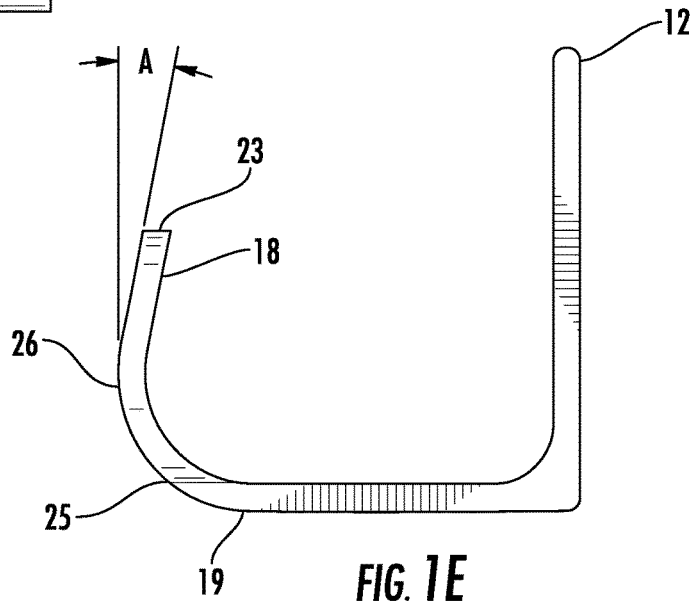
FIG. 1E is a right side view of the wheeled board and accessories rack.
Figure 1F:
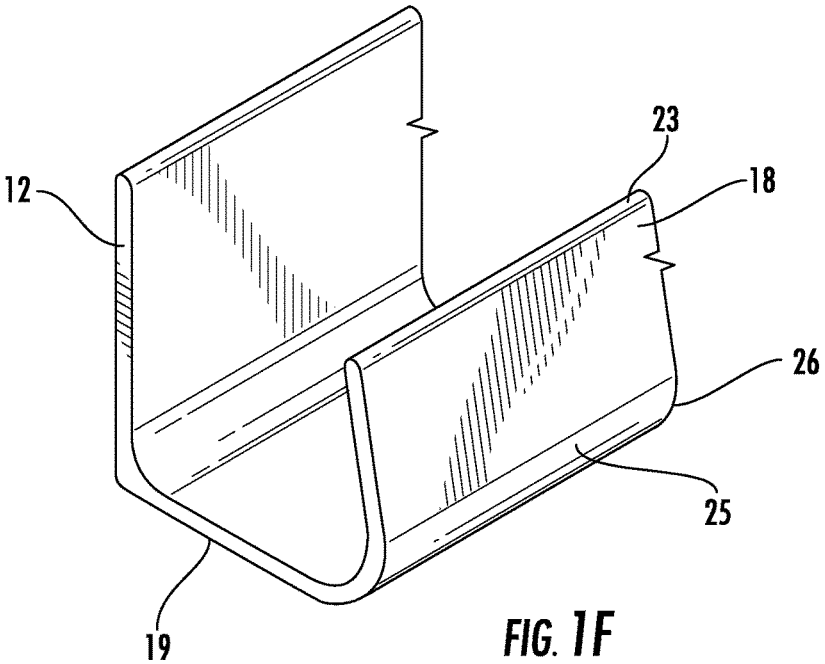
FIG. 1F is a perspective view of the lip.

In this embodiment six protrusions 18 are formed in rack 10. Each of protrusions 18 have the same size and each of notches 20 have the same size to allow protrusions 18 to be evenly spaced from one another. The spacing S between vertical axis 22 of adjacent protrusions 18*a* and 18*b* and vertical axis 22 of adjacent protrusions 18*b* and 18*c* is the same, as shown in FIG. 1B. In a preferred embodiment, spacing S is about six inches. In one embodiment, notch 20 can have a width W sufficient to accommodate a truck which attaches to skateboard wheels or to a scooter, as shown in FIG. 1C. An example scooter, is manufactured by RAZOR. For example, notch 20 can have a width W in the range of about 2.0 inches to about 4.0 inches. Preferably, width W is about 2.9 inches. Notches 20 can include rounded corners 21. Protrusions 18 can have a rounded top portion 23, as shown in FIG. 1D. Top portion 23 can be rounded in a semi-circular shape. Each protrusion 18 is vertically symmetric around vertical axis 22. Protrusion 18 includes curved side walls 24 extending to base support 19. Bottom portion 25 of front wall 26 of protrusion 18 is curved from base support 19, as shown in FIG. 1E and FIG. 1F. Top portion 23 of front wall 26 of protrusion 18 is angled toward rear support 12. Top portion 23 can be angled at an angle A in the range of about 5 degrees to about 15 degrees. In a preferred embodiment angle A is about 10 degrees.

Rack 10 can have a length in the range of about 20 inches to about 40 inches. In a preferred embodiment of rack 10 including six protrusions 18, rack 10 has a length of about 33 inches.

Rear support 12 and lip 16 can be integral to one another. In one embodiment rack 10 is formed of a one-piece construction of an extrusion of a metal or plastic material. For example the metal material can be aluminum or recycled aluminum.

Figure 2A:
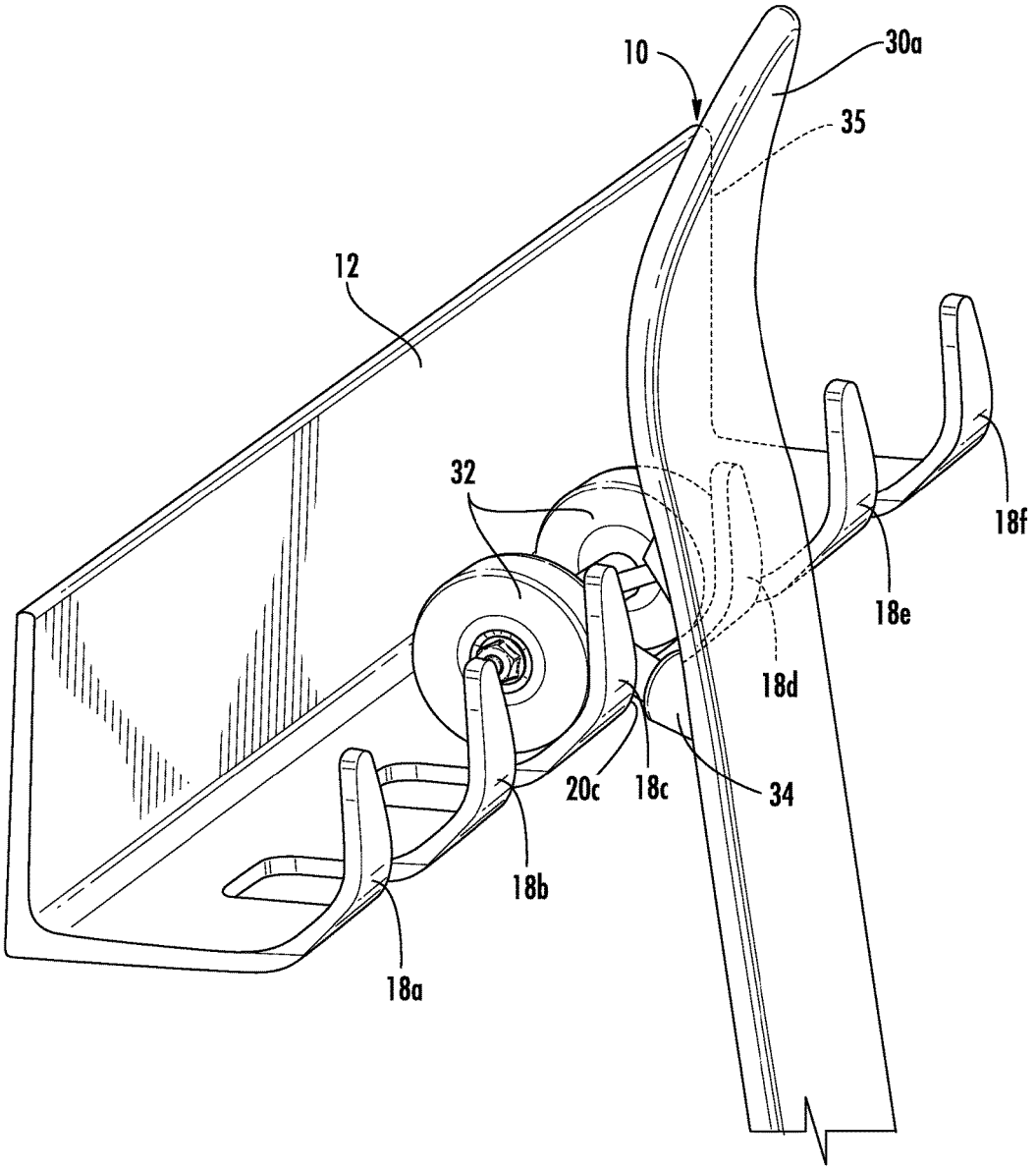
FIG. 2A is a schematic diagram of the wheeled board and accessories rack during operation.
Figure 2B:
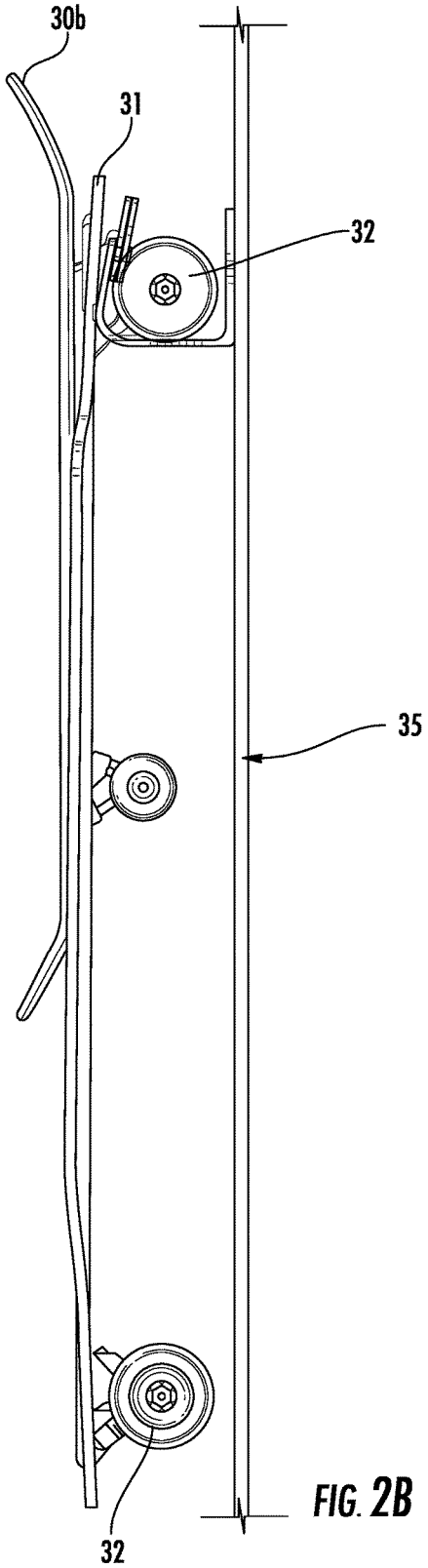
FIG. 2B is a schematic diagram of the wheeled board and accessories rack during operation for retaining a skateboard and long board.
Figure 2C:
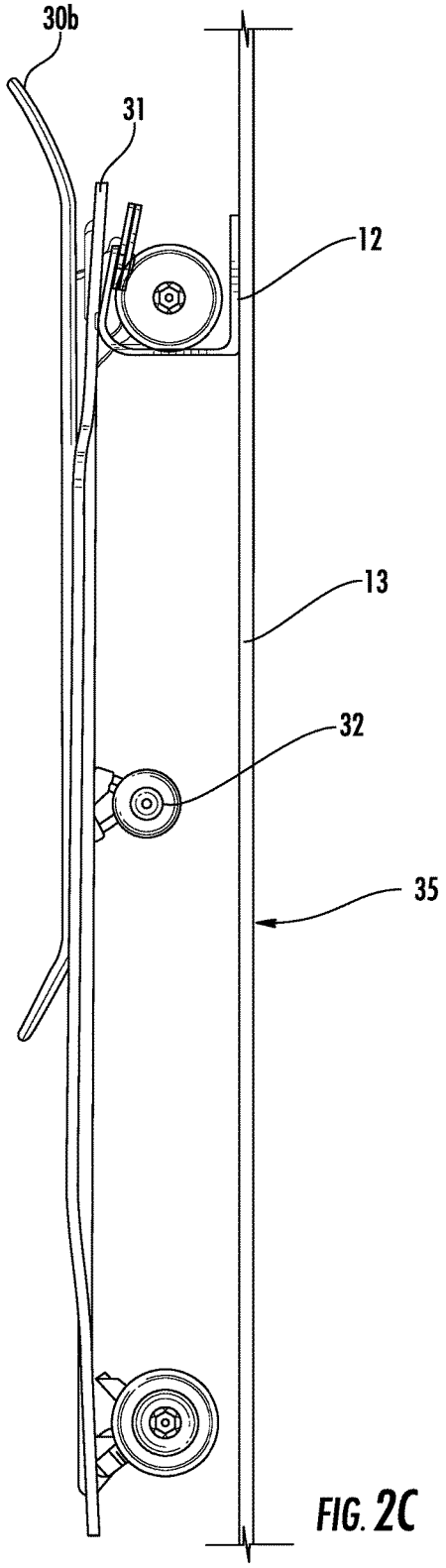
FIG. 2C is a schematic diagram of the wheeled board and accessories rack during operation for retaining a skateboard and long board.
Figure 3A:
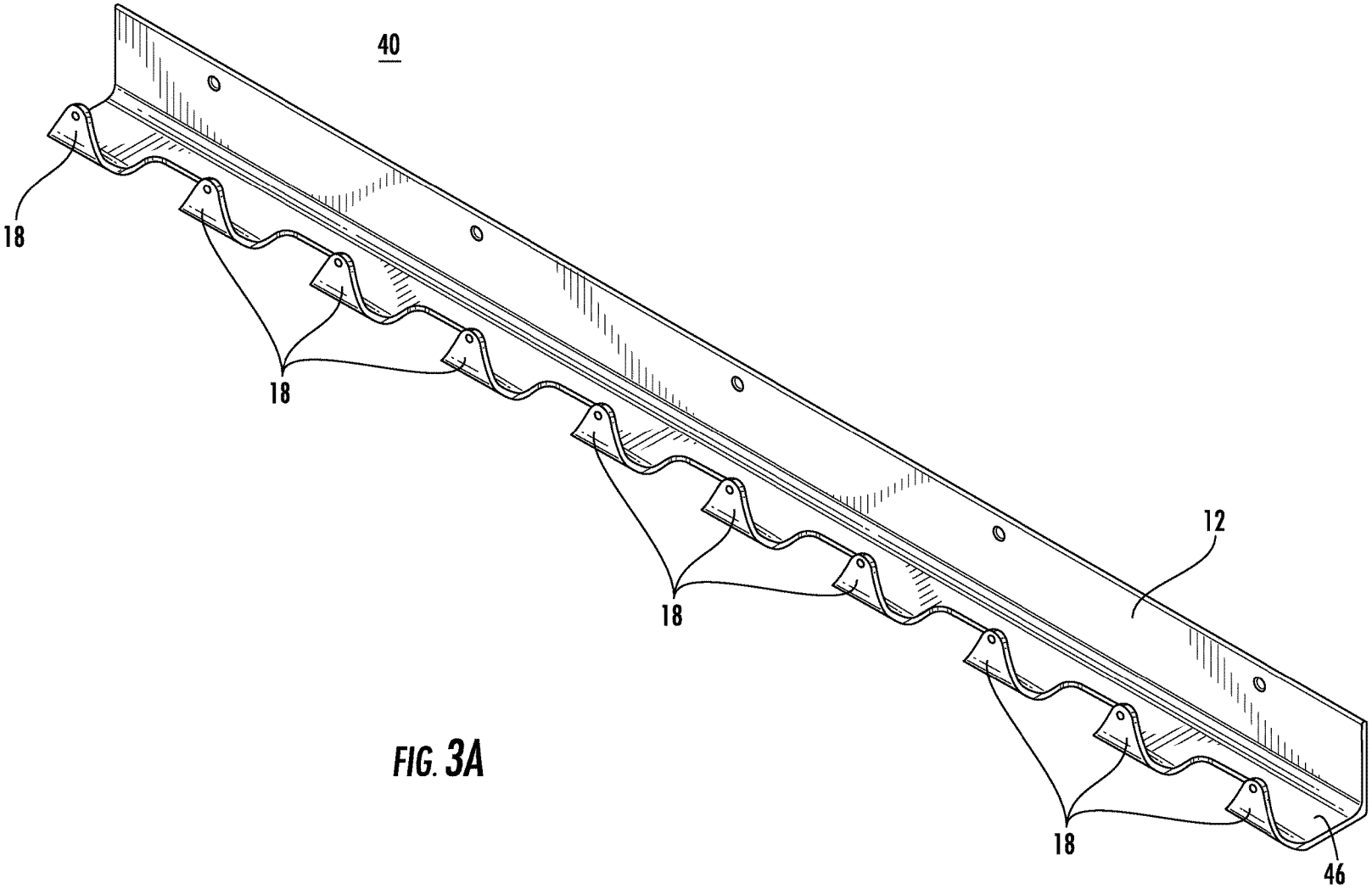
FIG. 3A is a perspective view of a wheeled board and accessories rack in accordance with the teachings of the present invention.
Figure 3B:
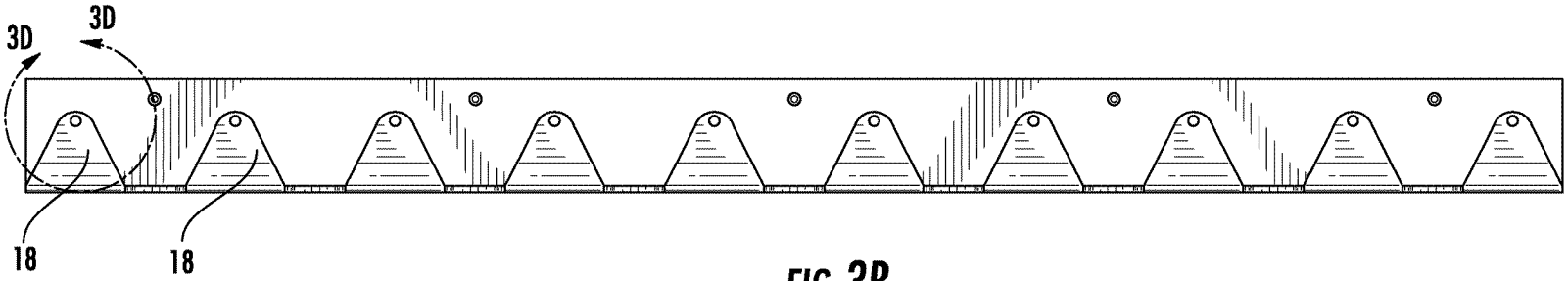
FIG. 3B is a front view of the wheeled board and accessories rack shown in FIG. 3A.
Figure 3C:
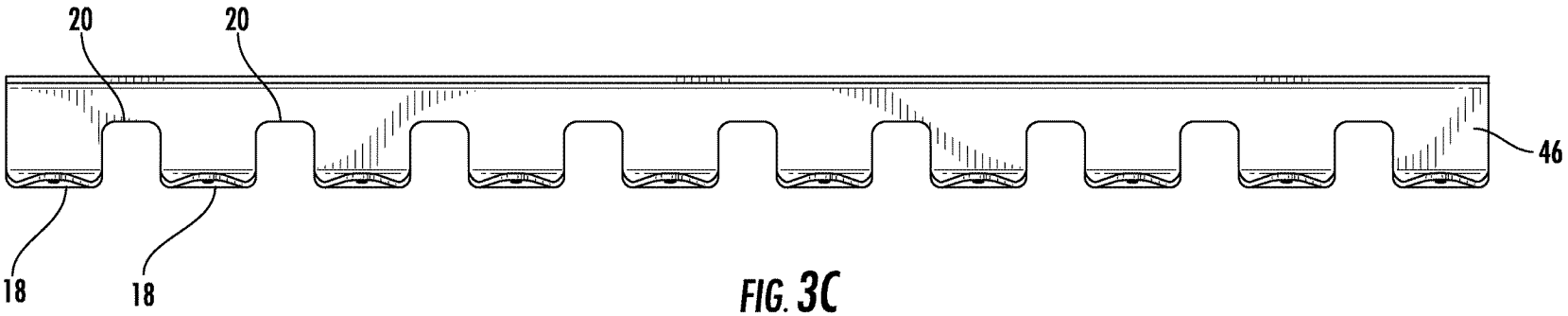
FIG. 3C is a top plan view of the wheeled board and accessories rack shown in FIG. 3A.
Figure 3D:
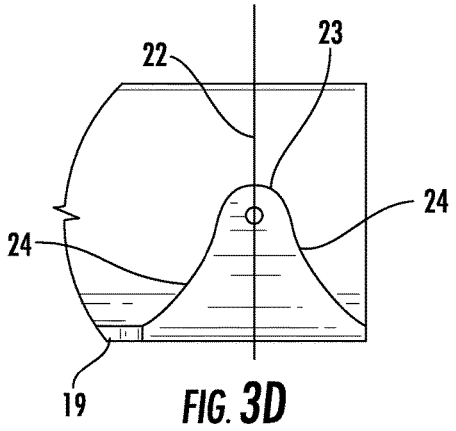
FIG. 3D is a detail view of feature B of FIG. 3B.
Figure 3E:
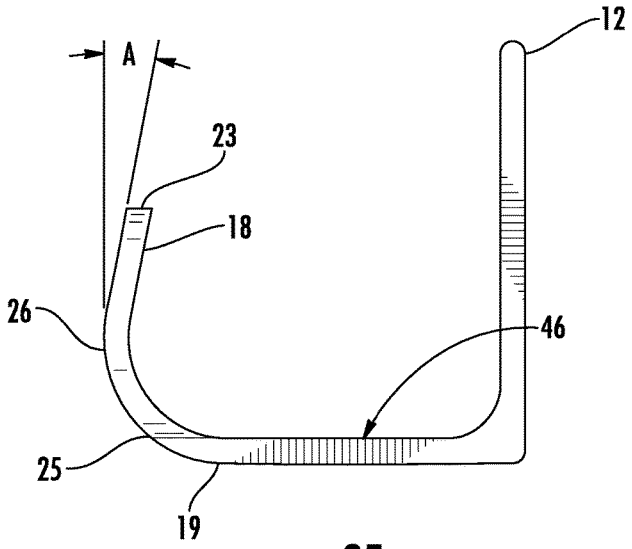
FIG. 3E is a right side view of the wheeled board and accessories rack shown in FIG. 3A.
Figure 3F:
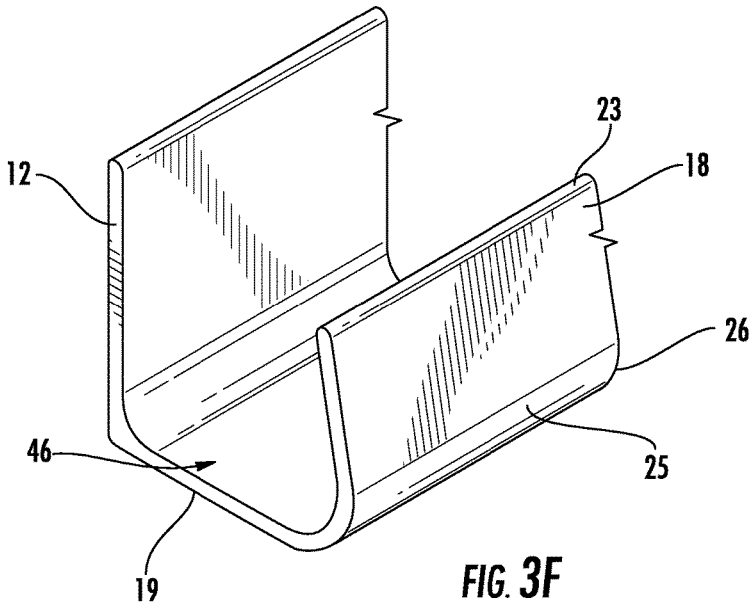
FIG. 3F is a perspective view of the lip.

FIG. 2 illustrates operation of rack 10 for retaining skateboard 30*a*. Skateboard 30*a* includes wheels 32 connected by truck 34 to skateboard 30*a*. Wheels 32 are retained by adjacent protrusions 18*c* and 18*d*. Truck 34 is positioned within notch 20*c*. Notch 20*c* is positioned between protrusions 18*c* and 18*d*. Angle A of top portion 23 of lip prevents skateboard 30 from contacting wall 35. FIGS. 2B-2C shown rack 10 attached to wall 35. Skateboard 30*b* and longboard 31 are retained by rack 10. Angle A of top portion 23 of lip prevents longboard 31 from contacting wall 35, as shown in FIG. 2B. Angle A of top portion 23 of lip prevents skateboard 30*b* from contacting wall 35, as shown in FIG. 2C. Alternatively, protrusions 18 can be used to retain scooters or accessories including for example backpacks, purses, umbrellas, helmets, and the like.

FIGS. 3A-3E illustrate an alternate embodiment of wheeled board and accessories rack 40 in accordance with the teachings of the present invention. In this embodiment, lip 46 is formed of ten protrusions 18.

Rack 40 can have a length in the range of about 40 inches to about 60 inches. In a preferred embodiment of rack 40 including ten protrusions, rack 40 has a length of about 56 inches. It will be appreciated that in accordance with the teachings of the present invention a rack can be formed of any length with any number of protrusions.

Figure 4A:
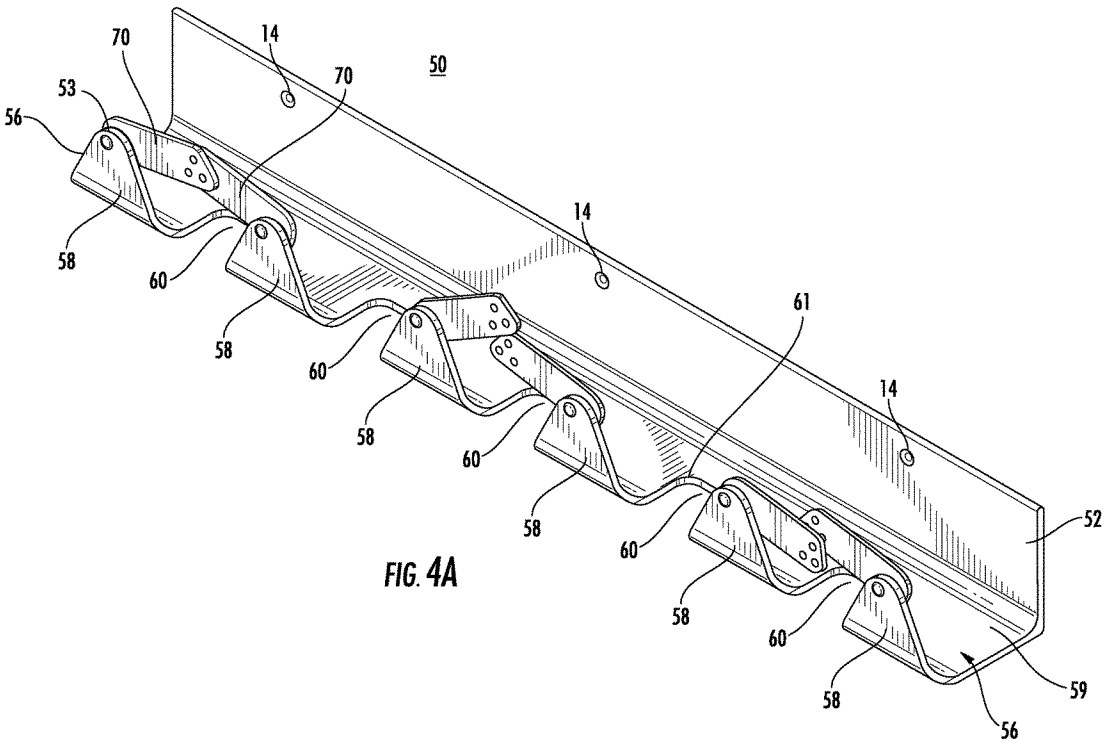
FIG. 4A is a perspective view of a wheeled board and accessories rack including a locking device in accordance with the teachings of the present invention.
Figure 4B:
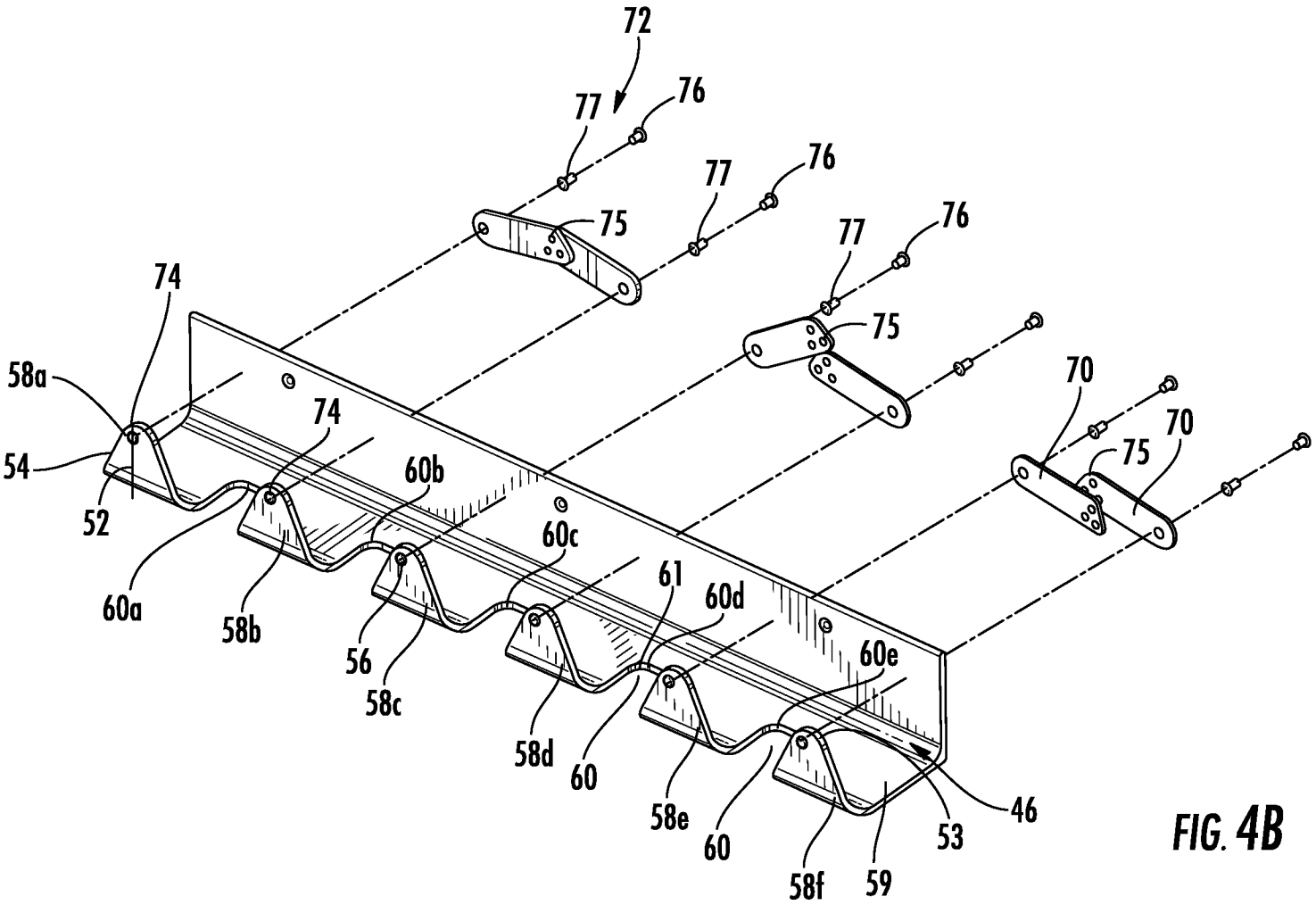
FIG. 4B is a schematic front view of the wheeled board and accessories rack shown in FIG. 4A showing connections of the locking devices.
Figure 4C:
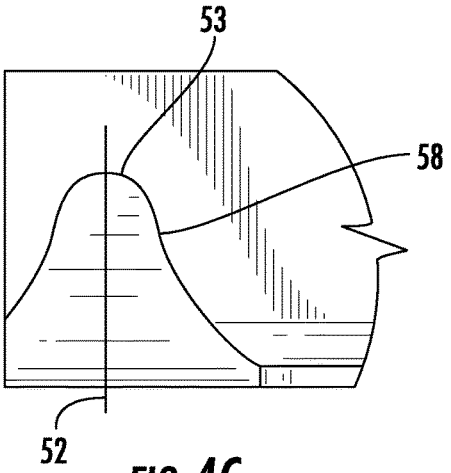
FIG. 4C is a detail view of FIG. 4B.

FIGS. 4A-4G illustrate an alternate embodiment of wheeled board and accessories locking rack 50. Lip 56 extends substantially horizontally from rear support 52, as shown in FIG. 4A. Lip 56 is formed a plurality of protrusions 58 extending from base support 59. Notches 60 are positioned between adjacent protrusions 58. Notches 60 include rounded corners 61. In this embodiment six protrusions 58 are formed in rack 50. Each of protrusions 58 have the same size and each of notches 60 have the same size to allow protrusions 58 to be evenly spaced from one another, as shown in FIG. 4B. Pivot 72 can include rivet 76 and bushing 77 attached to protrusion 78, as shown in FIG. 4C.

Figure 4D:
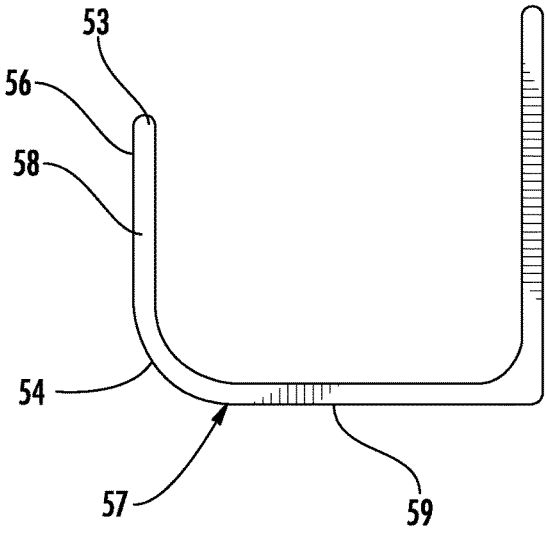
FIG. 4D is a right side view of the wheeled board and accessories rack.
Figure 4E:
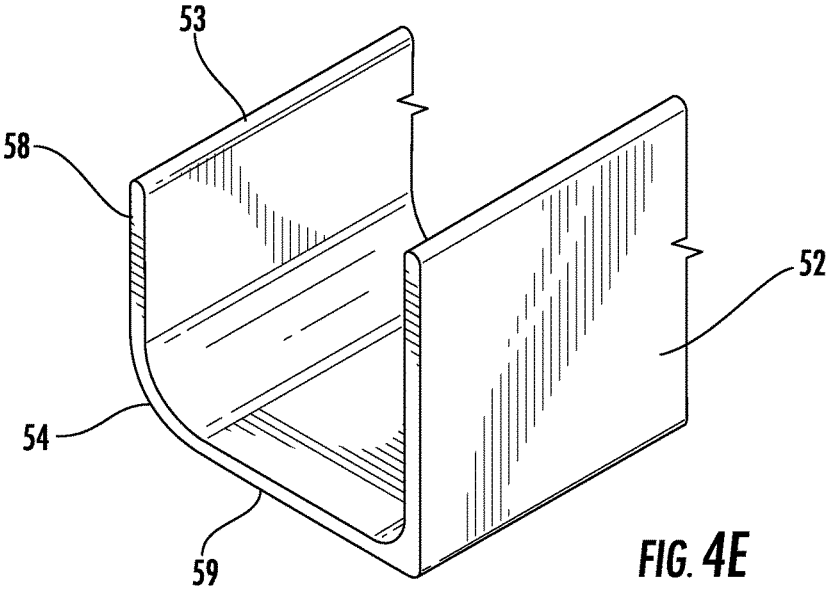
FIG. 4E is a perspective view of the lip.
Figure 5A:
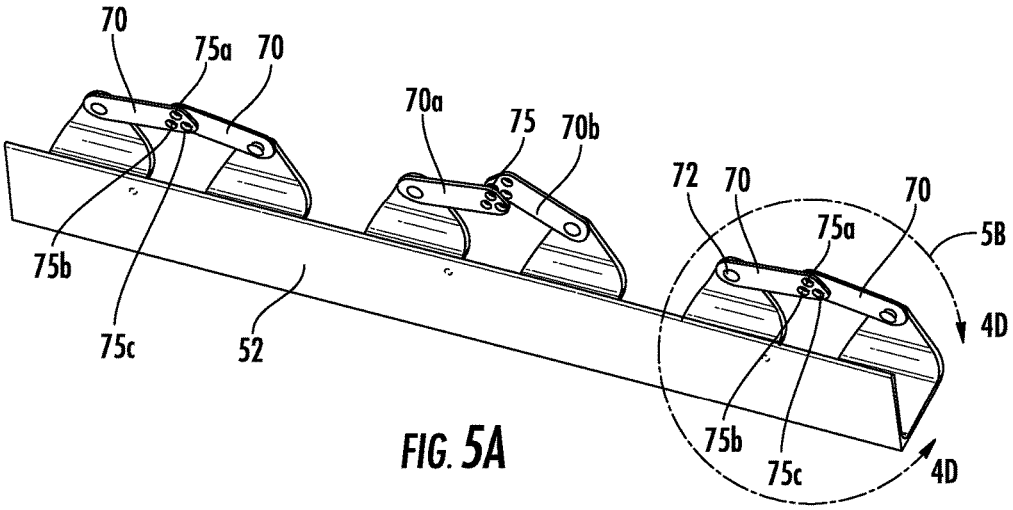
FIG. 5A is a rear view of the wheeled board and accessories rack shown in FIG. 4A.
Figure 5B:
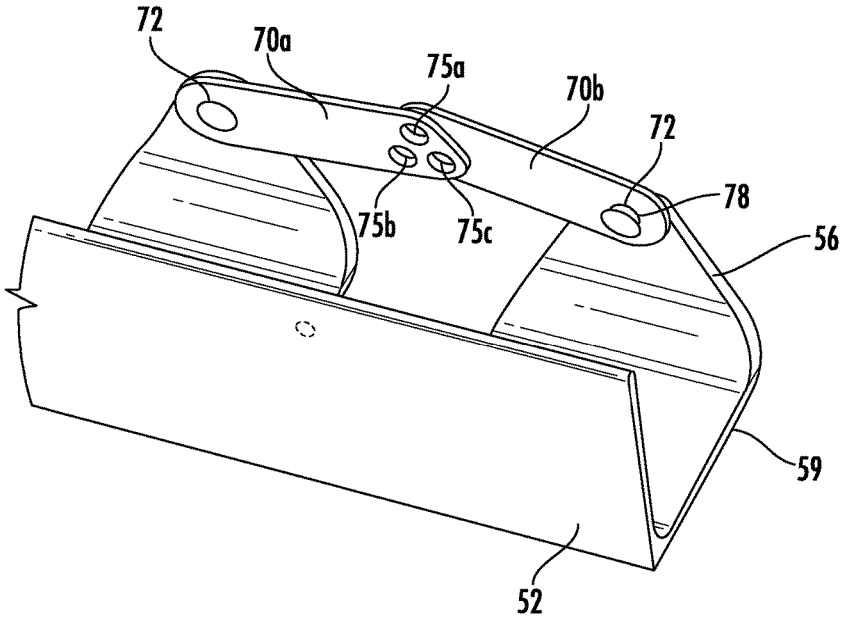
FIG. 5B is a detail view of FIG. 5A.
Figure 5D:
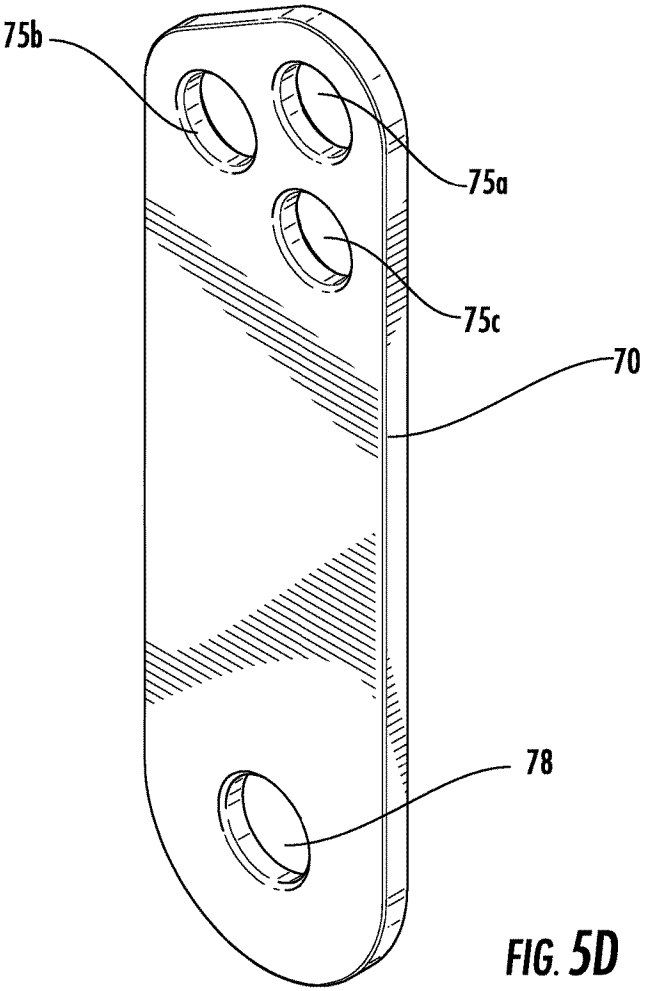
FIG. 5D is a detailed perspective view of the locking arm.
Figure 5C:
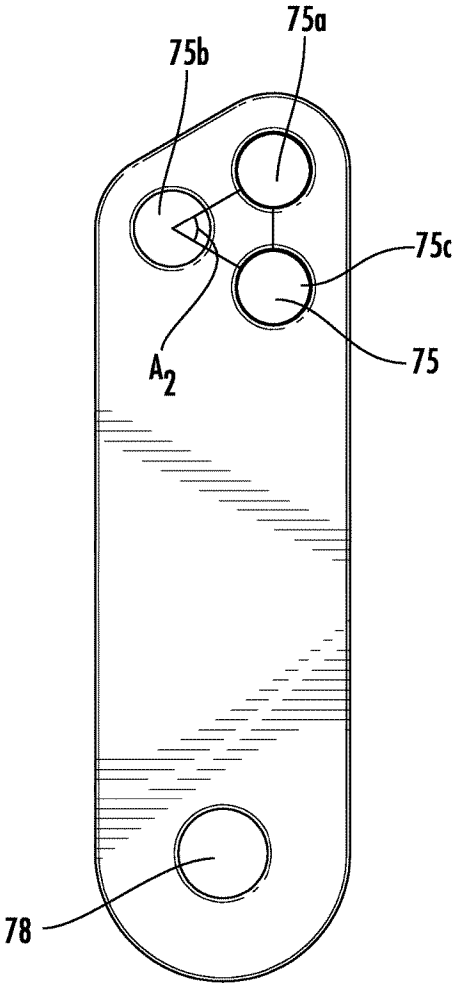
FIG. 5C is a detailed front view of the locking arm.

Protrusions 58 have a rounded top portion 53. Top portion 53 can be rounded in a semi-circular shape. Each protrusion 58 is vertically symmetric around vertical axis 52. Protrusion 58 includes curved side walls 54 extending to base support 59, as shown in FIG. 4D. Front wall 56 of protrusion 58 is substantially perpendicular to base support 59, as shown in FIG. 4E.

Locking arm 70 is rotatably coupled to a respective protrusion 58. Locking arm 70 can be coupled with pivot 72 to aperture 74, as shown in FIGS. 4C-4D. Aperture 74 is positioned at top portion 53 of protrusion 70. Locking arm 70 includes one or more locking apertures 75.

In one embodiment three locking apertures 75*a*-75*c* are formed in locking arm 70 in a triangular pattern of an angle $A_2$ of 60 degrees to one another, as shown in FIGS. 5A-5D. Pivot 72 allows locking arm 70*a* to swivel in aperture 78 for lining up at least one of locking apertures 75*a*-75*c* of locking arm 70*a* with at least one adjacent locking apertures 75*a*-75*c* of locking arm 70*b* for providing various locking combinations. Locking rack 50 can be slightly larger than rack 10 to accommodate all skateboards and allow the functionality of the locking mechanism.

Figure 6:
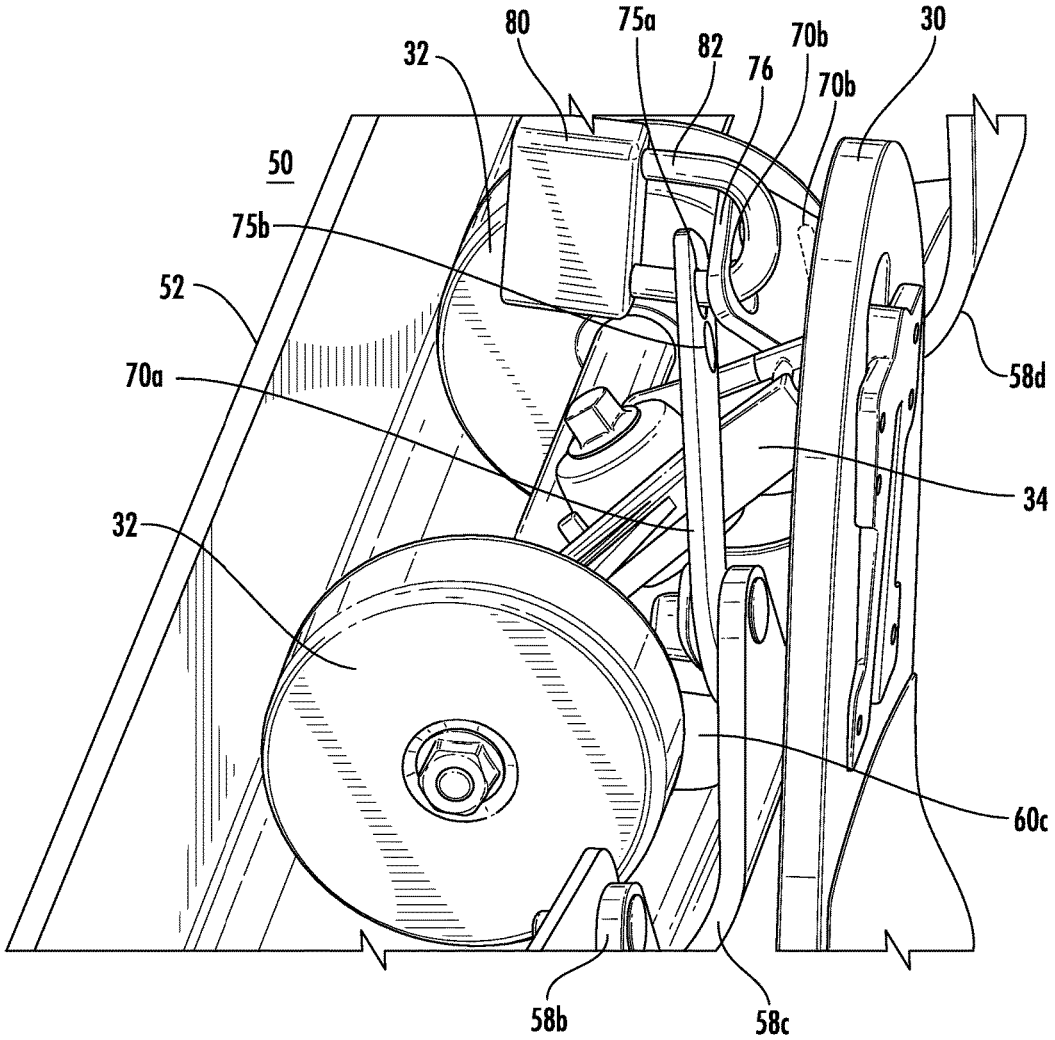
FIG. 6 is a schematic diagram of the wheeled board and accessories rack including a locking device during operation.
Figure 7A:
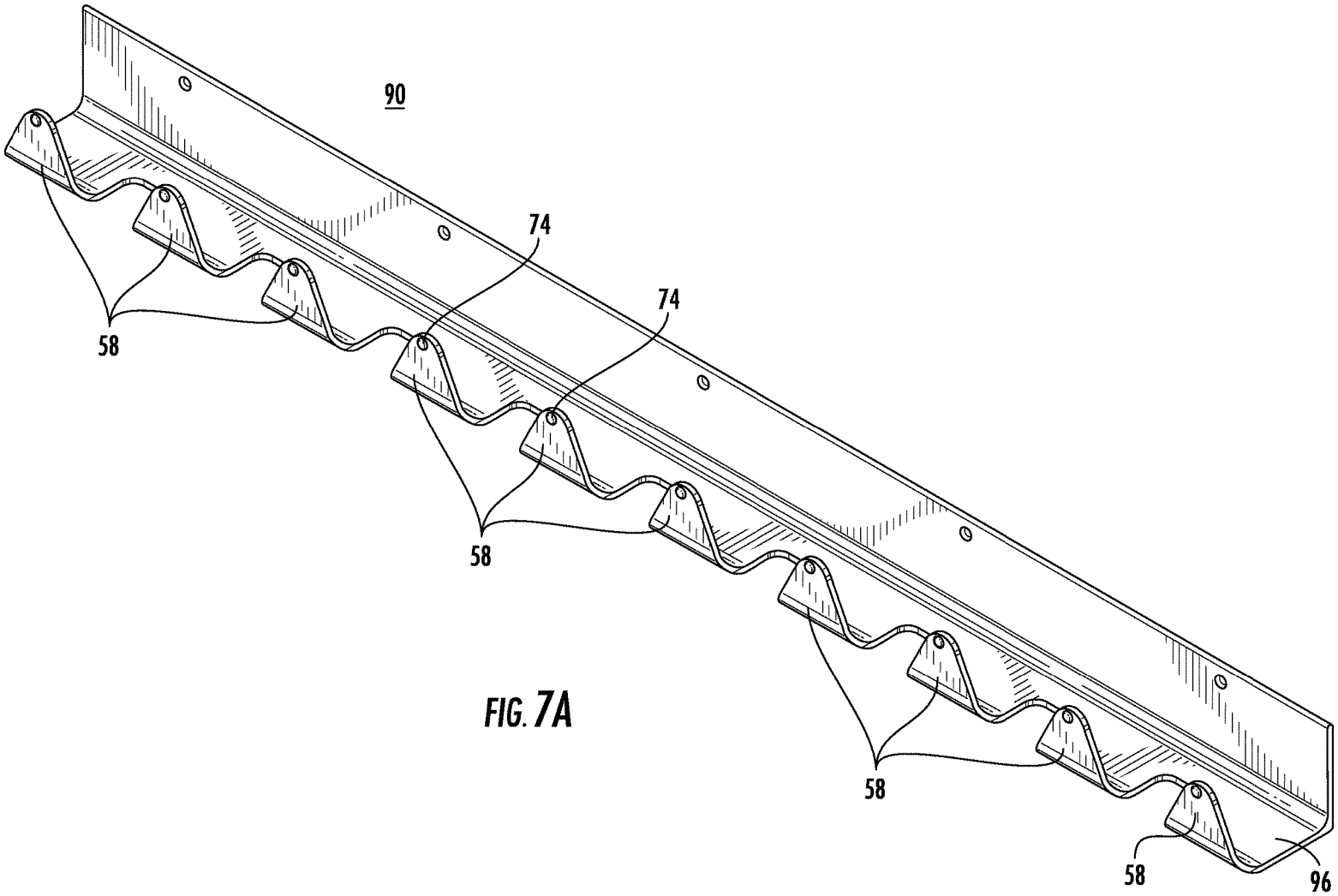
FIG. 7A is a perspective view of a wheeled board and accessories rack in accordance with the teachings of the present invention.
Figure 7B:
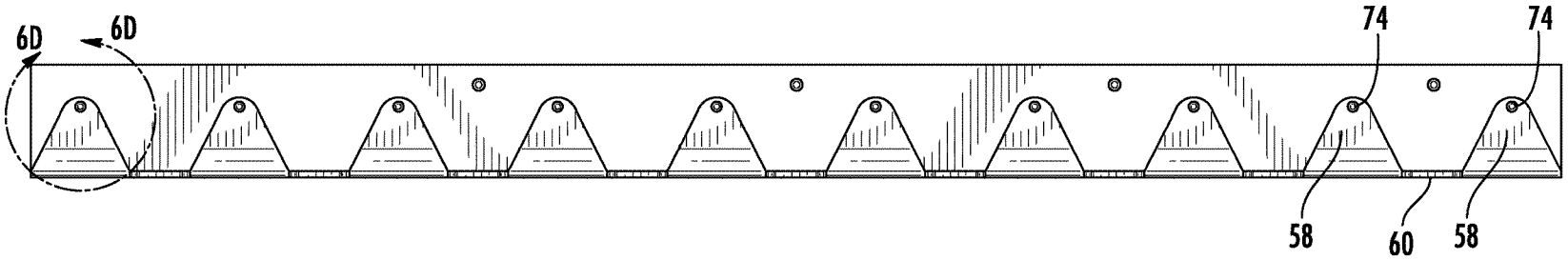
FIG. 7B is a front view of the wheeled board and accessories rack shown in FIG. 7A.
Figure 7C:
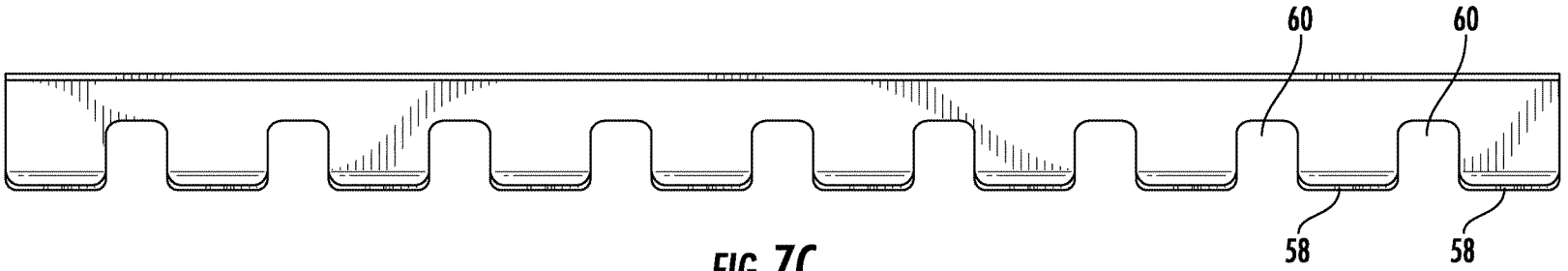
FIG. 7C is a top plan view of the wheeled board and accessories rack shown in FIG. 7A.
Figure 7D:
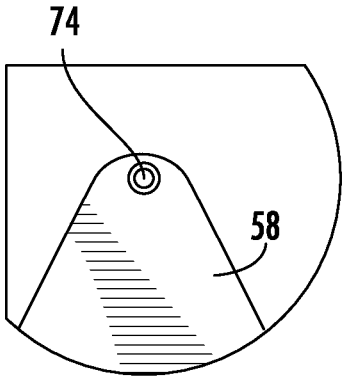
FIG. 7D is a detail view of feature A of FIG. 7B.
Figure 7E:
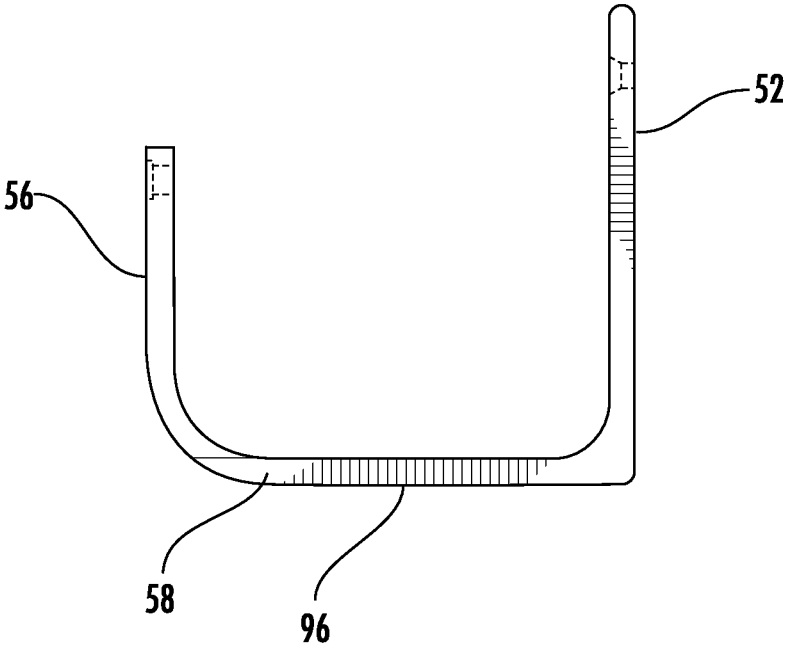
FIG. 7E is a right side view of the wheeled board and accessories rack shown in FIG. 7A.

FIG. 6 illustrates operation of locking rack 50 for locking skateboard 30 to locking rack 50. Wheels 32 are retained by adjacent protrusions 58*c* and 58*d*. Truck 34 is positioned within notch 60*c*. Notch 60*c* is positioned between protrusions 58*c* and 58*d*. One of locking apertures 75*a*, 75*b* or 75*c* of locking arm 70*a* is aligned with one of locking apertures 75*a*, 75*b* or 75*c* of locking arm 70*b*. Locking member 82 of lock 80 is received within the respective aligned locking apertures 75*a*, 75*b* or 75*c* of locking arm 70*a* and locking arm 70*b*. Locking member 82 is locked into lock 80. Lock 80 can be any conventional lock such as a padlock.

FIGS. 7A-7E illustrate an alternate embodiment of wheeled board and accessories locking rack 90 in accordance with the teachings of the present invention. In this embodiment, lip 96 is formed of ten protrusions 58.

Figure 8A:
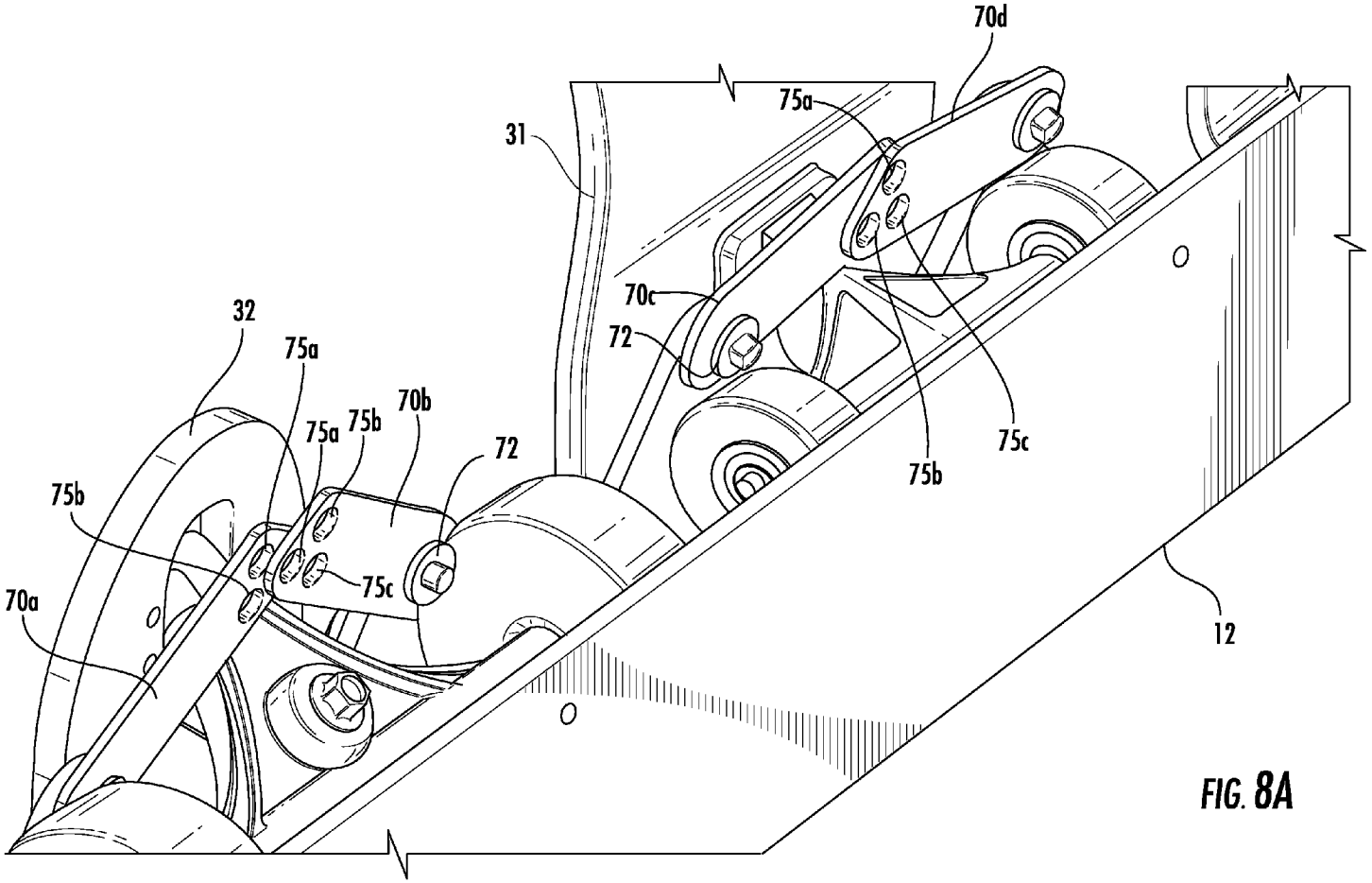
FIG. 8A is a schematic diagram of the wheeled board and accessories rack including a locking device during operation.
Figure 8B:
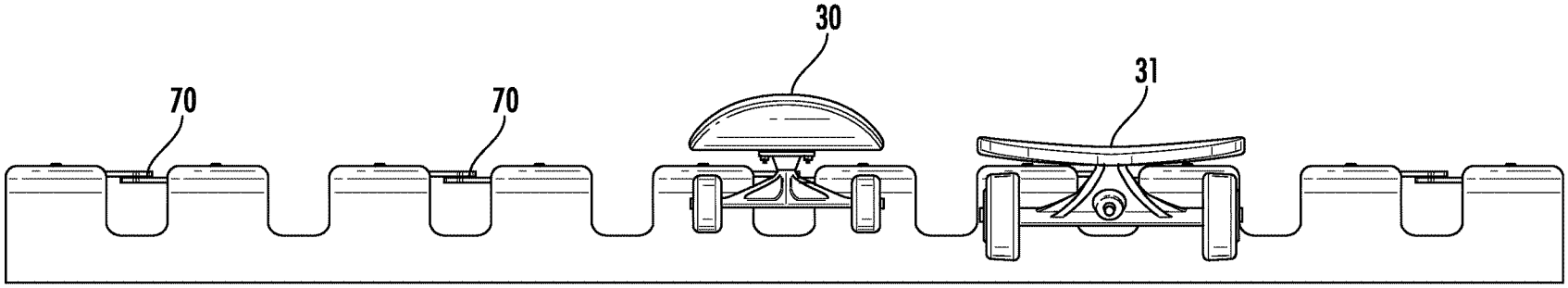
FIG. 8B is a schematic diagram of the wheeled board and accessories rack including a locking device during operation.

FIGS. 8A-8B illustrate operation of locking rack 50 for retaining skateboard 30 and longboard 31. One of locking apertures 75*a*, 75*b* or 75*c* of locking arm 70*a* is aligned with one of locking apertures 75*a*, 75*b* or 75*c* of locking arm 70*b*. One of locking apertures 75*a*, 75*b* or 75*c* of locking arm 70*c* is aligned with one of locking apertures 75*a*, 75*b* or 75*c* of locking arm 70*d*.

It is to be understood that the above-described embodiments are illustrative of only a few of the many possible specific embodiments, which can represent applications of the principles of the invention. Numerous and varied other arrangements can be readily devised in accordance with these principles by those skilled in the art without departing from the spirit and scope of the invention.

What is claimed is:

1. A rack for retaining a skateboard, scooter or accessory comprising:

a rear support;

a lip extending from said rear support, said lip comprising a plurality of protrusions extending from a base support;

a notch positioned between adjacent ones of the protrusions; and an end of said base support being coupled or attached to said rear support, wherein said protrusions have a rounded top portion in semi-circular shape, the top portion of each of the plurality of protrusions is angled toward the base support at an angle of about 5 degrees to about 15 degrees and a pair of adjacent ones of the protrusions are adapted to retain the received skateboard, scooter or accessory at a distance laterally from the rear support.

2. The rack of claim 1 wherein the angle is about 10 degrees.

3. The rack of claim 1 wherein the notches include rounded corners.

4. The rack of claim 1 wherein each of the protrusions is the same size and each of the notch is the same size to allow the protrusions to be evenly spaced from one another.

5. The rack of claim 1 wherein a pair of adjacent ones of the protrusions are adapted to retain respective skateboard wheels or scooter wheels.

6. The rack of claim 1 wherein the rear support and the lip are integral to one another.

7. The rack of claim 1 wherein the rack is formed of a one-piece construction of an extrusion of a metal or plastic material.

8. The rack of claim 1 wherein the rack is formed of recycled aluminum.

9. The rack of claim 1 wherein the rack comprises six or ten of the protrusions.

10. The rack of claim 1 wherein each of the protrusions is vertically symmetric around a vertical axis.

11. The rack of claim 1 wherein each of the protrusions has a bottom portion of a front wall that is curved and forms the base support.

* * * * *